United States Patent [19]

Poole

[11] 4,346,887

[45] Aug. 31, 1982

[54] DONKEY CALF EXERCISING MACHINE

[76] Inventor: Leonard Poole, c/o Williamson, Esq., P.O. Box 36015, Cincinnati, Ohio 45236

[21] Appl. No.: 10,236

[22] Filed: Feb. 8, 1979

[51] Int. Cl.[3] ..... A63B 23/04

[52] U.S. Cl. ..... 272/117

[58] Field of Search ..... 272/71, 72, 93, 96, 272/116-120, 125, 126, 134, 135, 136, 143, 144

[56] References Cited

U.S. PATENT DOCUMENTS

| | | | |
|---|---|---|---|
| 2,932,509 | 4/1960 | Zinkin | 272/144 X |
| 3,010,720 | 11/1961 | Allard | 272/117 |
| 3,759,511 | 9/1973 | Zinkin et al. | 272/134 X |
| 3,850,430 | 11/1974 | Hamilton | 272/143 X |
| 3,905,599 | 9/1975 | Mazman | 272/118 |

FOREIGN PATENT DOCUMENTS

| | | | |
|---|---|---|---|
| 1016724 | 9/1952 | France | 272/116 |

OTHER PUBLICATIONS

"Coach and Athlete: Mini-Gym, Inc."; Apr. 1978; pp. 30, 31.

"Muscle Builder Magazine"; Mar. 1979; vol. 40, No. 3, pp. 11-13, 114.

*Primary Examiner*—Richard J. Apley

*Attorney, Agent, or Firm*—Leonard Williamson

[57] ABSTRACT

An exercising apparatus for developing an exerciser's calf muscles via Donkey Raises, said apparatus comprising: an upright front post means to support a horizontal linking means which is pivotally mounted on a horizontal member attached to said front post means; said horizontal linking means extending away from said front post means for a distance of about the length of an exerciser's head, neck and body trunk, in other words, from his head to about his upper ham string muscle; said linking means also being supported on its extended end by a leg means for safety and when at rest; a force resistence means attached to said extended end; said force resistence means having a substantially horizontal press member so that when he uses said apparatus, he squats and bends the trunk of his body forward to assume a donkey-like pose, said press member being positioned just above said exerciser's bent lower back. The apparatus is also equipped with a forearm support means, associated with said front post means, where he places his forearms for support of his trunk and for leverage. The exerciser then contacts the press with his lower back and exerts an upwardly directed force against said press and said force resistence means, and may then exert, periodically, an additional upwardly directed force against said press by flexing his calf muscles, raising his heels, and raising to his toes like a ballet dancer.

4 Claims, 3 Drawing Figures

DONKEY CALF EXERCISING MACHINE

TECHNICAL FIELD

This invention relates to an exercise apparatus, and more particularly, to an exercising device especially useful for an athlete to develop his calf muscles.

BACKGROUND OF THE PRIOR ART

Numerous devices have been developed for assisting in the forced exercise of calf muscles. Calf muscle development techniques are illustrated in "*Muscle—Builder & Power*", August/September 1976, Volume 17, Number 6, Joe Weider-Editor, Woodland Hills, Calif. Some techniques include leg press machines for stretching action; a technique comprising standing with heels on a block and raising the toe as high as possible; seated toe raises with a press on the thighs for a diamond-shaped look, standing toe raises, holding dumbbells in the exerciser's hands; and "Donkey Raises" performed with two heavy training partners sitting on the exerciser's lower back while he assumes a donkey-like post with his forearms resting on a table for incredible "continuous tension" sets.

In practicing "Donkey Raises" by that prior art technique, it is impossible without the aid of training partners; it is also difficult to accurately estimate the amount of force applied.

OBJECTS

Accordingly, it is a primary object of the present invention to provide an improved calf muscle exercise apparatus for athletes to perform continuous tension sets of Donkey Raises.

Another object is to provide an improved calf building apparatus for Donkey Raises which a person can employ without an assistant, and which can be employed to reliably apply the desired tension or stress to the calf muscles.

Yet another object is to provide a compact calf building apparatus for Donkey Raises.

SUMMARY OF THE INVENTION

An exercising apparatus for developing an exerciser's calf muscles via Donkey Raises, said apparatus comprising: an upright front post means to support a horizontal linking means which is pivotally mounted on a horizontal member attached to said front post means; said horizontal linking means extending away from said front post means for a distance of about the length of an exerciser's head, neck and body trunk, in other words, from his head to about his upper ham string muscle; said linking means also being supported on its extended end by a leg means for safety and when at rest; a force resistance means attached to said extended end; said force resistance means having a substantially horizontal press member so that when he uses said apparatus, he squats and bends the trunk of his body forward to assume a donkey-like pose, said press member being positioned just above said exerciser's bent lower back. The apparatus is also equipped with a forearm support means, associated with said front post means, where he places his forearms for support of his trunk and leverage. The exerciser then contacts the press with his lower back and exerts an upwardly directed force against said press and said force resistence means and may exert, periodically, an additional upwardly directed force against said press by flexing his calf muscles, raising his heels, and raising to his toes like a ballet dancer. The apparatus is adapted to be positioned on the floor.

BRIEF DESCRIPTION OF THE DRAWINGS

Other objects and advantages of the present invention will become apparent from the following detailed description taken in conjunction with the drawings.

DESCRIPTION OF THE PREFERRED EMBODIMENTS

Figure 1:
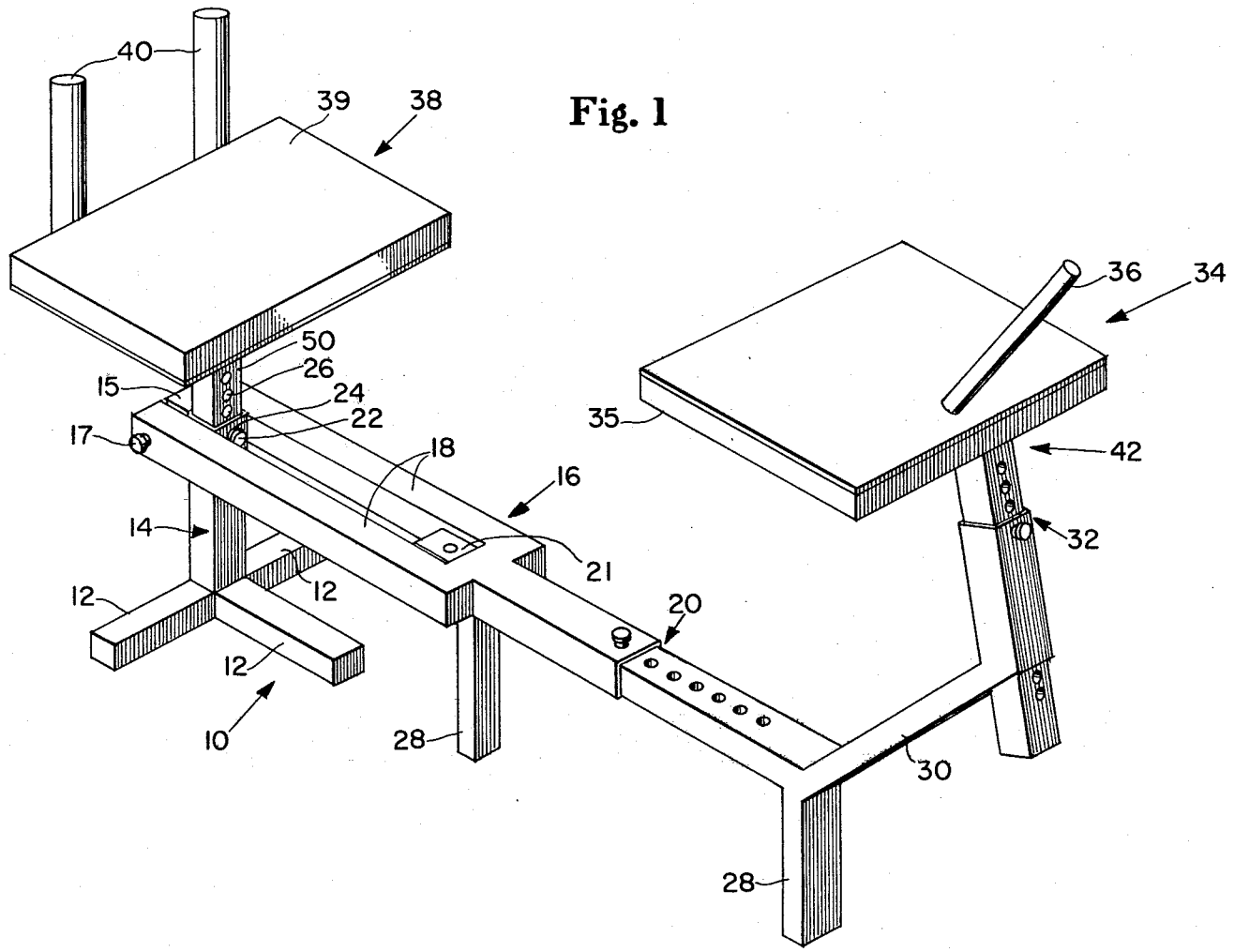
FIG. 1 is a perspective view of the exercising apparatus according to the present invention.

Referring now to FIG. 1 in detail, the exercise apparatus according to the present invention is indicated generally by the reference numeral 10 and includes a frame having a three point horizontal base portion 12 and a substantially upright front post means 14. The frame also has a substantially horizontal linking member generally referred to as 16 having two prongs 18 and an adjustable shaft portion 20 equipped with a pin 21 to adjust the length of the linking means 16 to fit an exerciser's body. The prongs 18 are pivotally mounted by pin 17 on a horizontal member 15 which is attached to the outer side of said front post means 14.

Legs 28 hold up the linking member 16 when the apparatus is not in use. At the end of adjustable shaft portion 20 is an upwardly inclined bar 30 which extends away from the front post means 14 and is attached to another upwardly inclined adjustable bar 32 which inclines back toward front post means 14. Mounted to bar 32 is a press 34 having a weight receiving means 36 for receiving weights for force resistance. A forearm support member 38 is mounted on the front post member 14 on an adjustable front post means, bar 50. The height of the forearm support member 38 is adjustable via key pin 22 which fastens through hole 24 and adjustable holes 26. The forearm support member 38 has two hand grips 40.

The frame is preferably made up of steel tubing bent and welded into the desired configuration. The top 39 of the forearm support means 38 and the bottom 35 of the press 34 is preferably made of padding.

Figure 2:
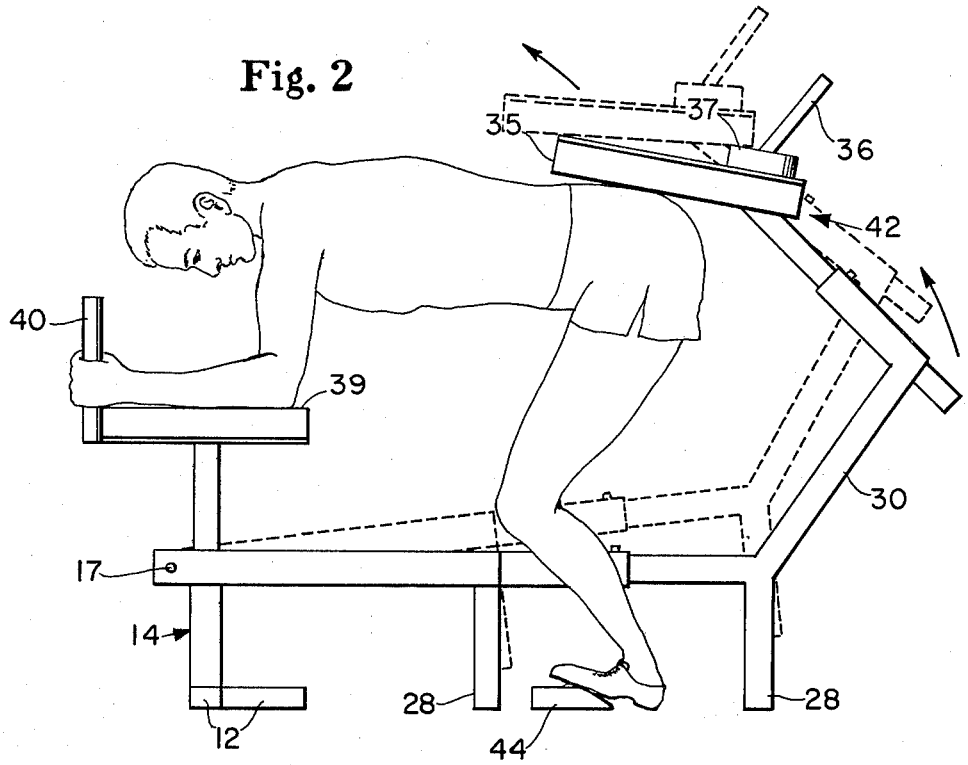
FIG. 2 is a side view of the apparatus shown in FIG. 1 being illustrated with a person.

Referring to both FIGS. 1 and 2, the horizontal linking means 16 extends for a length of about the exerciser's head, neck and trunk. Legs 28 are for floor support and safety. The press 34, 36 and weights 37 comprise a force resistance means generally referred to as 42. The forearm support member 38 is positioned in a space relation whereon the exerciser can place his forearms for leverage. The press 34 is positioned above his lower back whereby he may exert an upwardly directed force against it, causing the horizontal linking member 16 to pivot on pin 17, lifting the legs 28 off the floor. He may then exercise his calf muscles in continuous tension sets by exerting, periodically, an additional upwardly directed force against said force resistance means 42 by flexing his calf muscles, raising his heels like a ballet dancer. For an extra stretch, the exerciser may use a block 44 to place his toes so that his heels can go to the floor.

FIG. 2 is a side view of the apparatus shown in FIG. 1 being illustrated by a person on a donkey-like pose about to use it.

Figure 3:
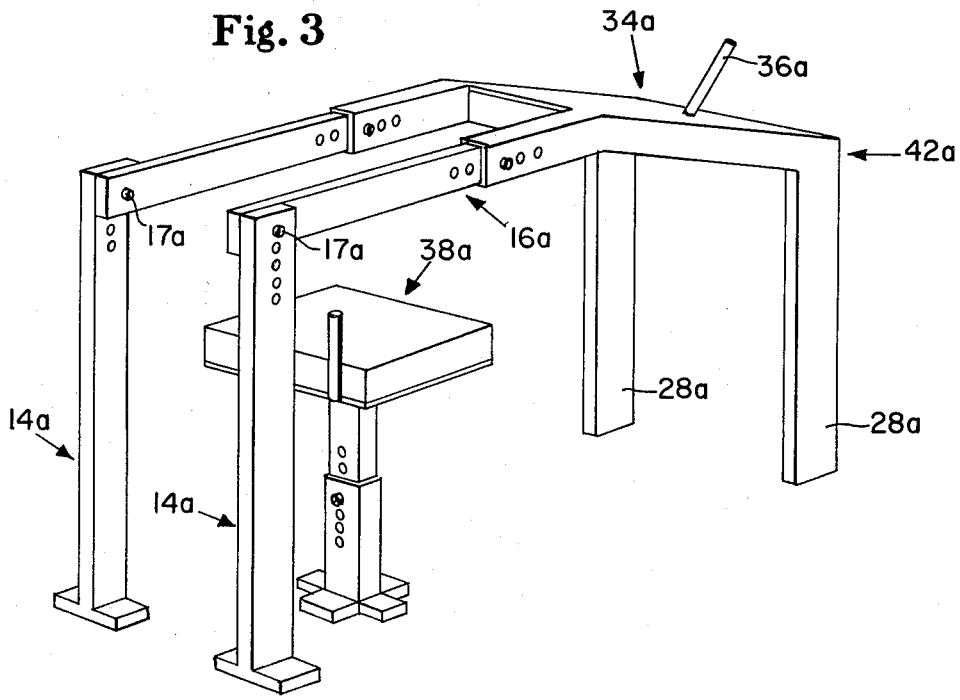
FIG. 3 is a side view of another embodiment of the present invention.

FIG. 3 is another embodiment of the present invention wherein the upright front post means 14*a* would be higher than the exerciser and the horizontal linking means 16*a* which pivots on pin 17*a*. Legs 28*a* lift off the floor. The force resistance means 42*a* comprises a press 34*a* and weight receiving means 36*a*. The forearm support means 38 is also shown.

It is apparent that various modifications of the above-described apparatus could readily be made without departing from the true nature of the invention. Accordingly, while the preferred and best modes contemplated are disclosed and described, it will be understood that the invention is not restricted solely thereto, and all embodiments thereof are included which would be apparent to one skilled in the art and which come within the spirit and scope of my invention.

What is claimed is:

1. An exercising apparatus for developing an exerciser's calf muscles, said apparatus comprising:

(a) an upright front post means for supporting a substantially horizontal linking means;

(b) said horizontal linking means pivotally mounted on a horizontal member attached to said upright front post means and extending for a length of about an exerciser's upper body, the extended end of said linking means having a leg means for safety and floor support when not in use;

(c) a force resistance means attached to the extended end of said linking means said force resistance means having a weight press member positioned in a spaced relation above the exerciser's lower back when he bends the trunk of his body forward and assumes a donkey-like pose;

(d) a forearm support means associated with said front post means and positioned in a special relation away from and at a lower elevation than that of said weight press member so that whereon the exerciser can place his forearms for leverage when in said donkey-like pose so that he may exert an upwardly directed force against said press with his lower back causing said horizontal linking means to pivot, and whereby he may exercise his calf muscles by periodically exerting an additional upwardly directed force against said press via Donkey Raise, said Donkey Raises being performed by flexing his calf muscles, like a ballet dancer, whereby he may perform continuous tension sets.

2. An exercising apparatus in accordance with claim 1 wherein said forearm support means is mounted on top of said upright front post means, and wherein said horizontal linking means comprises a fork having two prongs and a shaft portion, said prongs being pivotally mounted on said post means, said linking means being positioned at about said exerciser's calfs to about his thighs whereby said exerciser can straddle said linking means over said shaft portion, and wherein said force resistance means is connected to said shaft portion by a shaft extension member which inclines upwardly away from said front post and behind said exerciser to about his upper ham-string muscle, said shaft extension member then extending upwardly back towards said front post means at a related space distance and terminates with said weight press member, comfortably positioned over the exerciser's lower back.

3. The exercising apparatus of claim 2 wherein said front post means, said horizontal linking means and said force resistance means are all adjustably mounted to fit an exerciser's body.

4. The exercising apparatus in accordance with claim 1 wherein said upright front post means extends upwardly over the exerciser and said horizontal linking means is pivotally mounted over the exerciser's body when he is in said donkey-like pose.

* * * * *